US005596552A

United States Patent [19]

Lim

[11] Patent Number: 5,596,552

[45] Date of Patent: Jan. 21, 1997

[54] CIRCUIT FOR RESETTING TIME OF TIMER

[75] Inventor: Sang-il Lim, Suwon, Rep. of Korea

[73] Assignee: SamSung Electronics Co., Ltd., Suwon, Rep. of Korea

[21] Appl. No.: 802,569

[22] Filed: Dec. 5, 1991

[30] Foreign Application Priority Data

Dec. 31, 1990 [KR] Rep. of Korea ..... 90-23083

[51] Int. Cl.[6] ..... G04C 11/02

[52] U.S. Cl. ..... 368/47

[58] Field of Search ..... 368/47–61

[56] References Cited

U.S. PATENT DOCUMENTS

| | | | |
|---|---|---|---|
| 3,632,863 | 1/1972 | Hirashima . | |
| 4,187,518 | 2/1980 | Martin et al. . | |
| 4,204,167 | 5/1980 | Liu | 455/231 |
| 4,234,958 | 11/1980 | Pipes et al. | 375/107 |
| 4,310,854 | 1/1982 | Baer . | |
| 4,315,332 | 2/1982 | Sakami et al. | 368/55 |
| 4,358,836 | 11/1982 | Tohyama et al. | 368/47 |
| 4,569,598 | 2/1986 | Jacobs | 368/47 |
| 4,582,434 | 4/1986 | Plangger et al. | 368/55 |
| 4,633,421 | 12/1986 | Watson, Jr. et al. | 368/55 |
| 4,718,106 | 1/1988 | Weinblatt . | |
| 4,768,178 | 8/1988 | Conklin | 368/55 |
| 4,823,328 | 4/1989 | Conklin et al. | 368/55 |
| 5,068,838 | 11/1991 | Klausner et al. | 368/55 |

FOREIGN PATENT DOCUMENTS

| | | | |
|---|---|---|---|
| 096593 | 4/1988 | Japan | 368/55 |
| 1041859 | 9/1963 | United Kingdom . | |
| 1571972 | 7/1977 | United Kingdom . | |
| 1518892 | 7/1978 | United Kingdom . | |
| 2064176 | 6/1981 | United Kingdom . | |
| 2251319 | 1/1992 | United Kingdom | 368/47 |

*Primary Examiner*—Bernard Roskoski
*Attorney, Agent, or Firm*—Robert E. Bushnell, Esq.

[57] ABSTRACT

A circuit for resetting the time of a timer installed in an electrical appliance includes receiving means for receiving a broadcasting signal including a specific frequency signal, specific frequency detecting means for detecting the specific frequency signal from the receiving means, and counting means for counting the number of pulses detected by the specific frequency detecting means, thereby enabling the timer to be accurately reset every hour on the hour.

28 Claims, 3 Drawing Sheets

CIRCUIT FOR RESETTING TIME OF TIMER

BACKGROUND OF THE INVENTION

The present invention relates to a circuit for resetting the time of a timer installed in an electrical appliance, and particularly to a circuit for resetting the time of a timer installed in an electrical appliance which directly receives a broadcasting signal.

Generally, when a timer which can display the current time accurately is installed in an electrical appliance, the reserved functions are punctually performed at the desired time, i.e., for broadcast reception, recording, cooking, laundry, etc. However, due to their inaccurate timing, conventional timers fail to accurately display the current time. Therefore, for example, a television or video recorder set does not punctually operate at the programmed time set by a user, so that the set's function is performed before or after the preset time, resulting in errors in precisely performing the user-desired function when using the time of an internal timer.

The technique published in U.S. Pat. No. 4,860,288, designed to solve the above-described problem, discloses an autonomous radio timepiece having a time equalizing processor to control and autonomously correct the instantaneous time indication on the basis of reference time information received by radio transmission and is equipped with an improved device for temporarily interrupting the operation of the time display mechanism, while continuing the operation of the functional part of the radio timepiece.

SUMMARY OF THE INVENTION

Therefore, it is an object of the present invention to provide a circuit for resetting the time in a timer, capable of accurately corresponding to the current time by hourly resetting the time of a timer.

To achieve these and other objects, there is provided a circuit and method which receives a broadcasing signal, which comprises a sound signal mixed with a specific frequency signal, wherein the specific frequency signal represents the the current time. The circuit and method detect the specific frequency signal, count the number of pulses that are in the specific frequency signal and reset a timer to a time represented by the number of pulses counted, every hour on the hour.

BRIEF DESCRIPTION OF THE DRAWINGS

The foregoing and other objects, advantages and aspects of the present invention will be better understood from the following detailed description of the invention with reference to the accompanying drawings, in which.

DETAILED DESCRIPTION OF THE INVENTION

Figure 1:
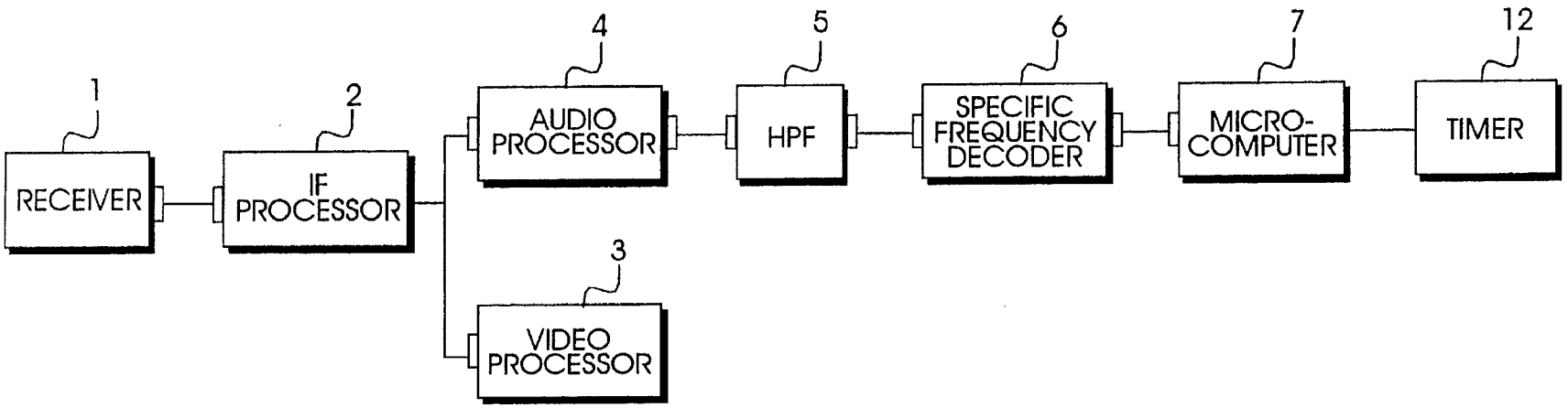
FIG. 1 is a block diagram showing an embodiment of a circuit for resetting the time of a timer according to the present invention.

FIG. 1 relates to an embodiment of a circuit for resetting the time of a timer according to the present invention, which is particularly adapted to a video cassette recorder (VCR).

The receiving means of FIG. 1 is composed of: a receiver 1 for receiving a broadcasting signal including a specific frequency signal; an intermediate frequency (IF) processor 2 for processing the signal from receiver 1 with an intermediate frequency signal; a video signal processor 3 for processing a video signal from IF processor 2; and an audio signal processor 4 for processing an audio signal from IF processor 2. The specific frequency detecting means includes a high-pass filter 5 for detecting a specific frequency signal (fs) processed with the audio signal from audio signal processor 4, and a specific frequency decoder 6 for decoding the waveform which is detected at a predetermined level in high-pass filter 5. Counting means is composed of a microcomputer 7 for counting the pulses from the specific frequency decoder 6. By this construction, the number of pulses detected by the specific frequency detecting means is counted, enabling the resetting of the time.

Figure 2:
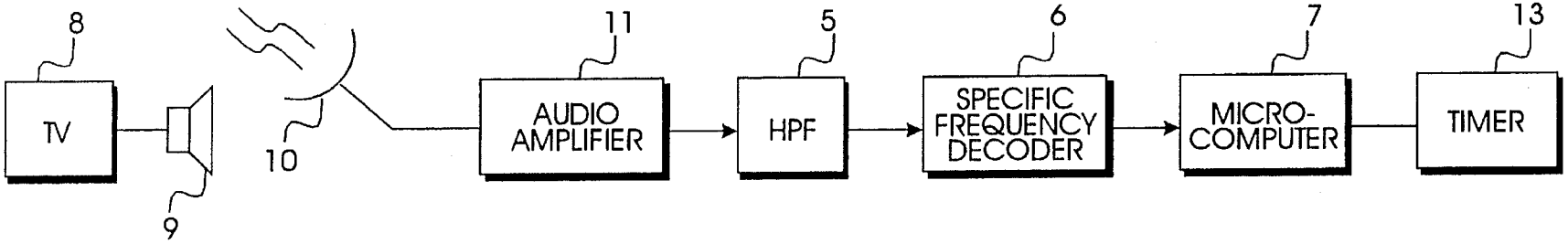
FIG. 2 is a block diagram showing another embodiment of a circuit for resetting the time of a timer according to the present invention.

FIG. 2 illustrates another embodiment of a circuit for resetting the time of a timer in an electrical appliance according to the present invention, which can be adapted to an appliance capable of receiving only an audio signal.

In FIG. 2, a sound wave receiving antenna 10 which can receive an audio signal from a speaker 9 of a television 8 is installed on the electrical appliance, so that the electrical appliance receives the audio signal from the television 8. The television audio signal received from the sound wave receiving antenna 10 is applied to an audio amplifier 11 to be sufficiently amplified, and then supplied to a high-pass filter 5. Therefore, high-pass filter 5 detects only the specific frequency signal, the specific frequency signal having been carried on the audio signal. The specific frequency signal detected in high-pass filter 5 is supplied to a specific frequency decoder 6, and then to a microcomputer 7. The specific frequency decoder 6 converts the amplitude level of the specific frequency signal to be recognizable by the microcomputer 7, so that the microcomputer 7 resets timer 13 to the current time upon receipt of the specific frequency signal.

Figure 3:
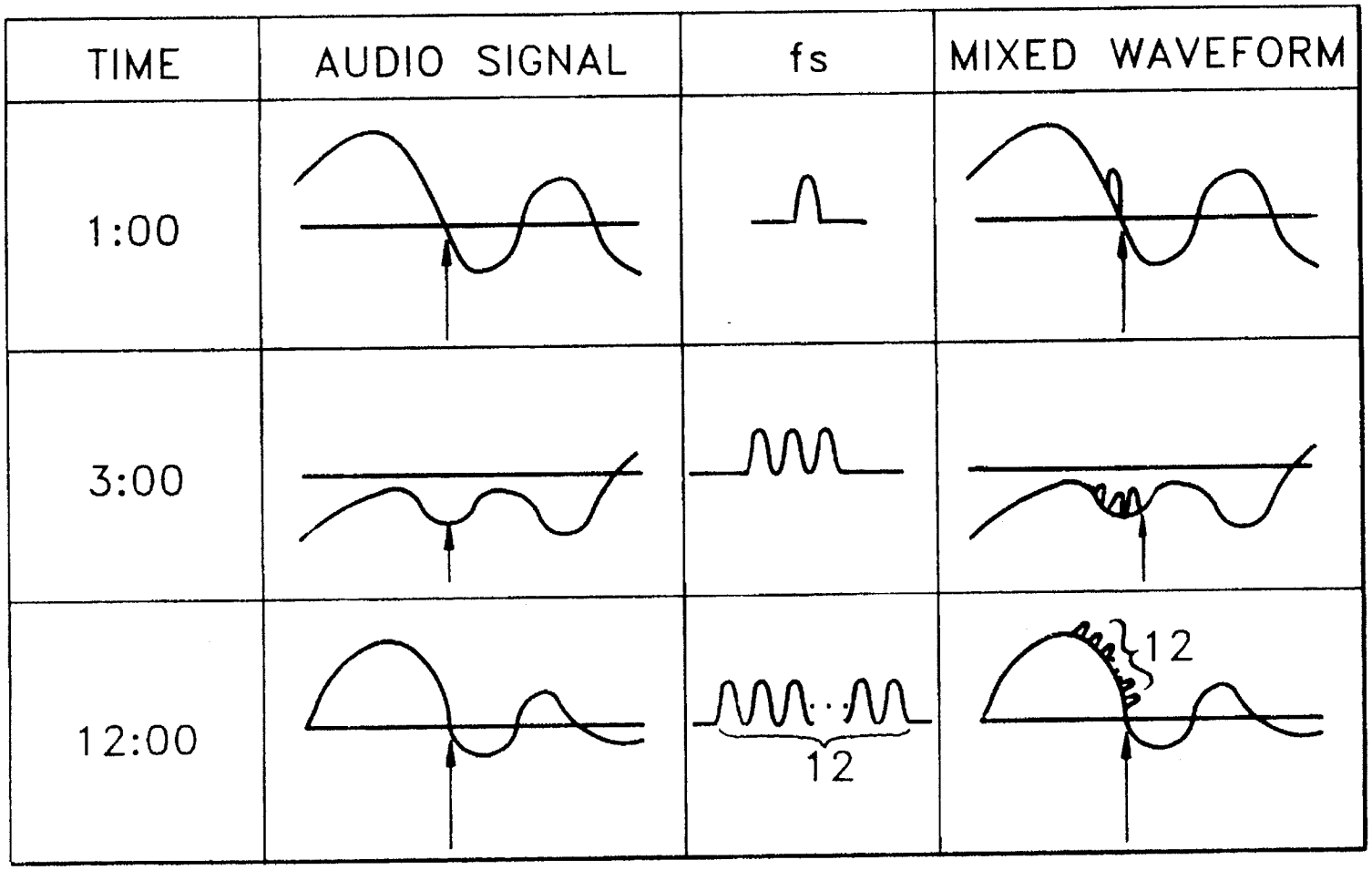
FIG. 3 shows the signal waveform of the radio frequency used for the circuit of the present invention.

FIG. 3 illustrates the radio frequency waveform used for the circuit of the present invention. That is, in the circuits of FIGS. 1 and 2, the specific frequency signal is mixed with the audio broadcasting signal from a broadcasting station as illustrated in FIG. 3. Here, the mixing is carried out such that the specific frequency is above audible frequencies but within the frequency range of the microcomputer 7. The number of pulses of the specific frequency signal mixed with the audio signal is one at 1:00 A.M., 12 at noon, and 23 at 11:00 P.M. In addition to this, the specific frequency signal mixed with the audio signal is at a higher frequency than the audio signal which is audible. Also, the amplitude, period, and the interval between pulses of the specific frequency signal are set to their optimum conditions which can be detected by the microcomputer 7 without errors, in which the final specific frequency signal is loaded on the audio signal every hour on the hour.

Figure 4:
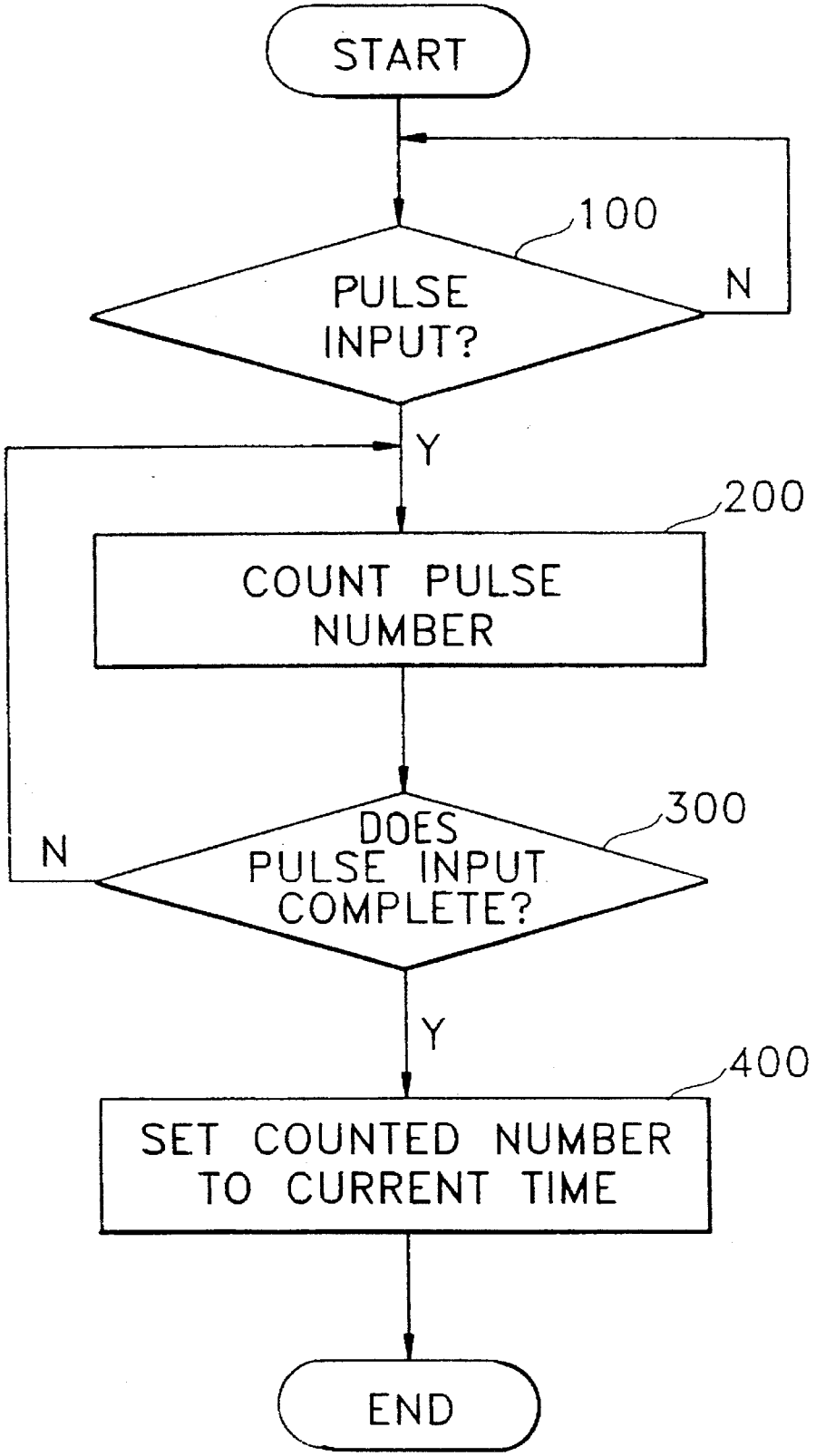
FIG. 4 is a flow chart showing the operation of the microcomputer timer in FIGS. 1 and 2.

FIG. 4 illustrates a flowchart showing the operation of the microcomputer timer 7 in FIGS. 1 and 2.

Referring to FIG. 4, the microcomputer 7 determines whether or not the pulse is input from the specific frequency decoder 6 in step 100, and when there is a pulse input, counts the number of pulses in step 200. The, microcomputer 7 counts the pulse input while continuously incrementing by one the pulse, number. When there is no further pulse input, steps 300, the microcomputer timer 7 sets the counted number to the current time in step 400. Therefore, the time of the timer is reset.

As a result, according to the present invention, although the time of a timer installed in an electrical appliance is incorrect, the time is accurately reset every hour on the hour, which allows reserved functions such as preprogrammed broadcast recording to be performed at the desired time and without errors.

At this time, by transmitting a specific frequency signal from a broadcasting station such that the ending point of the specific frequency pulse corresponds to every stroke of the hour, the end of the counting of the frequency pulses can accurately set the timer every hour on the hour.

What is claimed is:

1. A circuit for resetting a timer installed in an electrical appliance, comprising:

receiving means for receiving a signal mixed with a specific frequency time signal having pulses, said signal mixed with said specific frequency time signal being transmitted on an hourly basis;

specific frequency detecting means for receiving and detecting said pulses of said specific frequency time signal from said receiving means; and counting means for making a count of a number of said pulses detected by said specific frequency detecting means, and for resetting a timer every hour on the hour on the basis of said count, said timer being reset to a current hour of a day as determined by said count.

2. A circuit for resetting a timer as claimed in claim 1, wherein said receiving means comprises:

a receiver for generating an output signal in dependence upon said signal mixed with said specific frequency time signal;

an intermediate frequency processor for converting said output signal from said receiver into an intermediate frequency signal; and an audio signal processor for extracting an audio signal from said intermediate frequency signal, said audio signal containing said specific frequency time signal.

3. A circuit for resetting a timer as claimed in claim 1, wherein said receiving means comprises:

sound wave receiving antenna means for receiving said signal mixed with said specific frequency time signal; and audio amplifier means for amplifying said signal mixed with said specific frequency time signal received from said sound receiving antenna means.

4. A circuit for resetting a timer as claimed in claim 2, wherein said specific frequency detecting means comprises:

high-pass filter means for cutting off frequencies below said specific frequency time signal received form said receiving means; and specific frequency decoder means for decoding said specific frequency time signal from said high-pass filter means to a predetermined level.

5. A circuit for resetting a timer as claimed in claim 3, wherein said specific frequency detecting means comprises:

high-pass filter means for cutting off frequencies below said specific frequency time signal received from said receiving means; and specific frequency decoder means for decoding said specific frequency time signal from said high-pass filter means to a predetermined level.

6. A circuit for resetting a timer as claimed in claim 4, wherein said counting means comprises a microcomputer for counting said number of pulses from said specific frequency detecting means.

7. A circuit for resetting a timer installed in an electrical appliance, said circuit comprising:

receiving means for receiving a transmitted signal, the transmitted signal comprising a signal having an audio signal modulated with a time component at regular intervals, and for outputting said audio signal modulated with said time component;

separation means for separating and decoding said time component from said audio signal, and for outputting a separated time signal containing a number of time pulses based on said time component; and processing means for making a count of said number of time pulses contained in said separated time signal and for resetting a timer to a current time in response to said count, said current time being represented by said count, and at said regular intervals in response to said count.

8. The circuit as claimed in claim 7, wherein said receiving means comprises:

reception means for receiving said transmitted signal;

intermediate frequency processor means for converting said transmitted signal to an intermediate frequency; and audio signal processor means for extracting said audio signal from said intermediate frequency.

9. The circuit as claimed in claim 7, wherein said receiving means comprises:

sound wave receiving antenna means for receiving said transmitted signal; and amplifying means for amplifying said transmitted signal, and for generating said audio signal.

10. The circuit as claimed in claim 7, wherein said separation means comprises:

filter means for filtering said time component from said audio signal, to generate a filtered time signal; and decoding means for providing a readable signal to said processing means by decoding said filtered time signal.

11. The circuit as claimed in claim 8, wherein said separation means comprises:

filter means for filtering said time component from said audio signal, to generate a filtered time signal; and decoding means for providing a readable signal to said processing means by decoding said filtered time signal.

12. The circuit as claimed in claim 9, wherein said separation means comprises:

filter means for filtering said time component from said audio signal, to generate a filtered time signal; and decoding means for providing a readable signal to said processing means by decoding said filtered time signal.

13. The circuit as claimed in claim 7, wherein said time signal has a higher frequency than said audio signal.

14. The circuit as claimed in claim 7, wherein said separated time signal is readily received by said processing means by adjusting an amplitude, a period, and an interval between said time pulses of said separated time signal.

15. The circuit as claimed in claimed in claim 11, wherein said number of time pulses corresponds to an hour of a day.

16. The circuit as claimed in claim 12, wherein said number of time pulses corresponds to an hour of a day.

17. A method for resetting a timer installed in an electrical appliance by using a transmitted signal containing a signal modulated with a time component having pulse, said method comprising the steps of:

receiving said transmitted signal at regular intervals;

seperating said time component from said transmitted signal; and counting a number of said pulses contained in said time component of said transmitted signal; and resetting a timer at said regular intervals in response to said number of pulses counted, said number of pulses being indicative of a current time.

18. The method for resetting a timer as claimed in claim 17, wherein said step of receiving said transmitted signal comprises the steps of:

acquiring said transmitted signal; and converting said transmitted signal to an intermediate frequency; and extracting an audio signal signal containing said time component from said intermediate frequency.

19. The method for resetting a timer as claimed in claim 17, wherein said step of receiving said transmitted signal comprises the steps of:

acquiring said transmitted signal; and amplifying said transmitted signal to produce an audio signal.

20. The method of resetting a timer as claimed in claim 18, wherein said step of separating a time component from said transmitted signal comprises the steps of:

filtering said time component from said audio signal, to generate a filtered time signal; and decoding said filtered time signal.

21. The method of resetting a timer as claimed in claim 19, wherein said step of separating a time component from said transmitted signal comprises the steps of:

filtering said time component from said audio signal to generate a filtered time signal; and decoding said filtered time signal to generate a decoded time signal.

22. The method of resetting a timer as claimed in claim 20, wherein said step of counting a number of pulses and resetting the timer comprises the steps of:

determining whether any pulses from said decoded time signal exist;

counting the number of pulses contained in said decoded time signal until there are no more pulses to be counted; and resetting the timer based on said number of pulses contained in said decoded time signal.

23. The method of resetting a timer as claimed in claim 21, wherein said step of counting a number of pulses and resetting the timer comprises the steps of:

determining whether any pulses from said decoded time signal exist;

counting the number of pulses contained in said decoded time signal until there are no more pulses to be counted; and resetting the timer based on said number of pulses contained in said decoded time signal.

24. A circuit for resetting a timer in response to a received audio signal mixed with a specific frequency signal, said circuit comprising:

filter means for separating said specific frequency signal from said audio signal;

decoder means for decoding said specific frequency signal separated by said filter means and for generating a number of pulses in response to said specific frequency signal; and means for providing a count of said number of pulses and for resetting said timer to a time corresponding to said count.

25. The circuit as set forth in claim 24, wherein said specific frequency signal is mixed with said audio signal at a frequency higher than the frequency of said audio signal and said filter means comprises a high pass filter.

26. The circuit as set forth in claim 25, wherein said decoder means comprises a frequency decoder.

27. The circuit as set forth in claim 24, wherein said count providing and resetting means comprises a microcomputer.

28. A method for resetting a timer in response to a received audio signal mixed with a specific frequency signal, said method comprising the steps of:

separating said specific frequency signal from said audio signal;

decoding said specific frequency signal separated from said audio signal;

generating a number of pulses in response to the decoded specific frequency signal;

providing a count of said number of pulses; and resetting said timer to a time corresponding to said count.

* * * * *

UNITED STATES PATENT AND TRADEMARK OFFICE

CERTIFICATE OF CORRECTION

PATENT NO. : 5,596,552
DATED : 21 January 1997
INVENTOR(S) : Sang–Il Lim

It is certified that error appears in the above-indentified patent and that said Letters Patent is hereby corrected as shown below:

Column 1, Line24, change "4,860,288" to --4,860,268--;

IN THE CLAIMS

Column 3, line 54, change "form" to --from--;

Column 5, line 18, delete "signal" (first occurance);

Column 5, line 1, change "pulse" to --pulses--:

Signed and Sealed this

Nineteenth Day of August, 1997

*Attest:*

*Attesting Officer*

BRUCE LEHMAN

*Commissioner of Patents and Trademarks*